US006647718B2

(12) United States Patent
Stephenson

(10) Patent No.: US 6,647,718 B2
(45) Date of Patent: Nov. 18, 2003

(54) ELECTRONICALLY CONTROLLED HYDRAULIC SYSTEM FOR LOWERING A BOOM IN AN EMERGENCY

(75) Inventor: Dwight B. Stephenson, Delafield, WI (US)

(73) Assignee: Husco International, Inc., Waukesha, WI (US)

( * ) Notice: Subject to any disclaimer, the term of this patent is extended or adjusted under 35 U.S.C. 154(b) by 103 days.

(21) Appl. No.: 09/970,761

(22) Filed: Oct. 4, 2001

(65) Prior Publication Data

US 2003/0066417 A1 Apr. 10, 2003

(51) Int. Cl.[7] ..... F15B 11/22
(52) U.S. Cl. ..... 60/403; 91/515; 414/708
(58) Field of Search ..... 60/403, 405; 91/515; 414/700, 708

(56) References Cited

U.S. PATENT DOCUMENTS 4,923,362 A * 5/1990 Fryk ..... 414/700
5,083,894 A * 1/1992 Ikari et al. ..... 414/700
5,152,142 A * 10/1992 Budzich ..... 60/414
5,797,310 A * 8/1998 Casey et al. ..... 91/515

OTHER PUBLICATIONS

Keith Williams, *Coordinated Boom Control System for Roug h Terrain Forklifts*, SAE Technical Paper 911832, Society of Automotive Engineers, Warrendale PA, Sep. 9–12, 1991.

* cited by examiner

*Primary Examiner*—F. Daniel Lopez
(74) *Attorney, Agent, or Firm*—Quarles & Brady LLP

(57) ABSTRACT

An industrial lift truck has a boom that is raised and lowered by a first hydraulic actuator and a load carrier that is pivoted with respect to the boom by a second hydraulic actuator. In the event that the supply of hydraulic fluid for powering the actuators fails, the boom may be lowered by gravity by draining fluid from the first hydraulic actuator. To prevent a load from sliding off the load carrier as the boom descends, the load carrier is pivoted to maintain a substantially constant angular relationship to the ground. This is accomplished by selectively conveying fluid drained under pressure from the first hydraulic actuator into the second hydraulic actuator. Changes in the position of the boom are sensed and, in response, the flow of fluid into the second hydraulic actuator is controlled to produce corresponding changes in the load carrier position.

18 Claims, 2 Drawing Sheets

ELECTRONICALLY CONTROLLED HYDRAULIC SYSTEM FOR LOWERING A BOOM IN AN EMERGENCY

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to hydraulic systems for operating mechanical members, such as booms of agricultural, construction and industrial equipment; and particularly to operating the hydraulic system in an emergency, such as when power to a hydraulic pump of the equipment is lost.

2. Description of the Related Art

Industrial equipment, such as lift trucks, have moveable members which are operated by hydraulic cylinder and piston arrangements. Application of hydraulic fluid to the cylinder traditionally has been controlled by a manual valve, such as the one described in U.S. Pat. No. 5,579,642. A manual operator lever was mechanically connected to move a spool within the valve. Movement of the spool into various positions with respect to cavities in the valve body enables pressurized hydraulic fluid to flow from a pump to one of the cylinder chambers and be drained from another cylinder chamber. The rate of flow into the associated chamber is varied by varying the degree to which the spool is moved, thereby moving the piston at proportionally different speeds.

Because the manual valves are mounted in or near the operator cab of the equipment, individual hydraulic lines have to be run from the valve to the associated cylinders. There is a present trend away from manually operated hydraulic valves toward electrical controls and the use of solenoid valves. This type of control simplifies the hydraulic plumbing as the control valves do not have to be located near the operator cab. Instead, the solenoid valves are mounted adjacent the associated cylinders, thereby requiring that only a hydraulic line from the pump and another line back to the fluid tank need to be run through the equipment. Although electrical signals have to be transmitted from the operator cab to the solenoid valves, wires are easier to run and less prone to failure than pressurized hydraulic lines that must be flexible to accommodate movement of the equipment.

Industrial lift trucks require that the boom be capable of being lowered in a controlled manner should the engine fail thus removing power that drives the hydraulic pump. A simple way to provide this capability is to incorporate a valve that releases the hydraulic fluid in the boom cylinder, thereby enabling the boom to descend under the force of gravity. However, a load carrier is pivotally attached to the boom in many types of equipment and simply lowering the boom will cause the load carrier to tilt downward and allow a load to fall off. Thus even in an emergency, hydraulic power must be applied to a load carrier cylinder to maintain the load carrier level as the boom lowers. A previous solution was to incorporate a hand-operated emergency pump that supplied pressurized fluid to the cylinder that pivoted the load carrier with respect to the descending boom.

SUMMARY OF THE INVENTION

The present invention provides a method for operating hydraulic actuators on a machine in a controlled manner upon failure of the source of pressurized fluid that normally powers the actuators. The method is particularly useful to lower a boom of the machine that is operated by a first hydraulic actuator. A load carrier, pivotally coupled to the boom, is operated by a second hydraulic actuator.

During a failure of the hydraulic power source, fluid can be drained under pressure from the first hydraulic actuator, thereby enabling the boom to descend under the force of gravity. The draining hydraulic fluid is conveyed from the first hydraulic actuator to the second hydraulic actuator to produce movement of the load carrier with respect to the boom. The flow of the hydraulic fluid into the second hydraulic actuator is controlled so that as the boom moves, the angular relationship of the load carrier with respect to a support surface on which the machine rests is maintained substantially constant. For example, during descent the angle between the boom and the support surface changes. The change is measured and the flow of the hydraulic fluid is controlled to alter load carrier's position with respect to the boom so that the load carrier remains level.

In one embodiment, sensors indicate the positions of the boom and the load carrier. For example a first angle between the boom and a carriage of the machine is sensed and a second angle between the boom and the load carrier is sensed. As the first angle changes, the hydraulic fluid flow into the second actuator is controlled to produce an equivalent change of the second angle of the load carrier. An amount of hydraulic fluid that is drained from the first actuator in excess of that required to operate the actuators is conveyed to a reservoir for the hydraulic system of the machine.

In another embodiment an inclinometer is attached to the load carrier to detect the angle of tilt with respect to the horizontal. In this version the flow of fluid to the second actuator is controlled to maintain the inclination of the load carrier substantially constant.

DETAILED DESCRIPTION OF THE INVENTION

Figure 1:
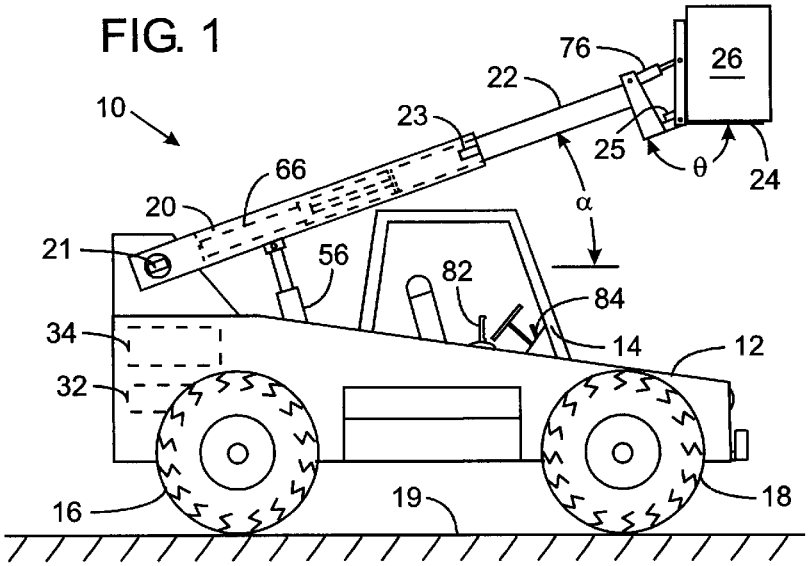
FIG. 1 is a schematic representation of an industrial lift truck that incorporates the present invention.

With initial reference to FIG. 1, an industrial lift truck 10, such as the illustrated telehandler, has a carriage 12 with an operator cab 14. The carriage 12 supports an engine or battery powered motor (not shown) for driving a pair of rear wheels 16 across the ground 19. A pair of front wheels 18 are steerable from the operator cab 14.

A boom 20 is pivotally attached to the rear of the carriage 12. A first position sensor 21 provides a signal indicating the angle $\alpha$ to which the boom has been raised. An arm 22 slides telescopically within the boom 20 and a second position sensor 23 provides a signal which indicates the distance that the arm 22 extends from the boom 20. A load carrier 24 is pivotally mounted at the end of the arm 22 that is remote from the boom 20 and can comprise any one of several structures lifting a load 26. For example, the load carrier 24 may have a pair of forks to lift a pallet on which goods are packaged. A third position sensor 25 provides a signal which indicates an angle θ to which the load carrier 24 has been tilted with respect to the arm 22. The signals from the position sensors 21, 23, and 25 are applied to an electronic controller on the industrial lift truck 10, as will be described.

Figure 2:
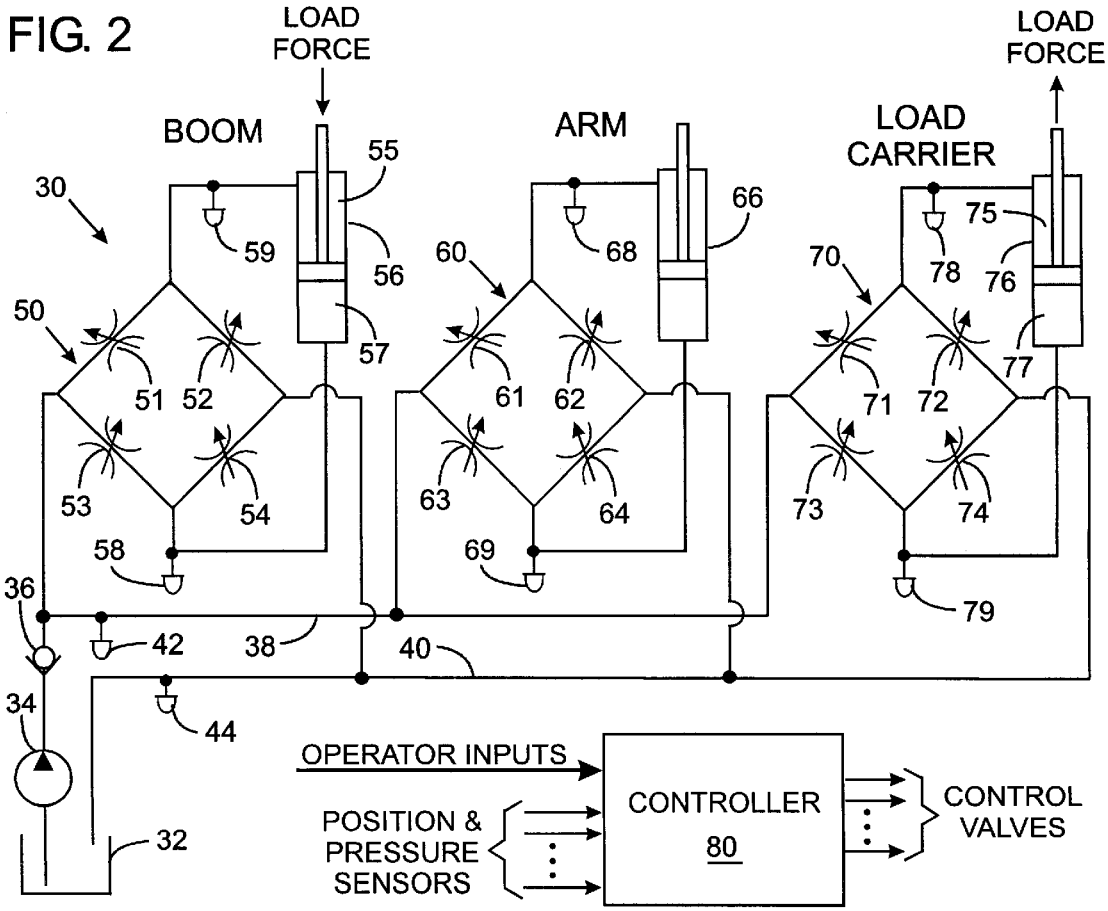
FIG. 2 is a schematic diagram of the hydraulic circuit of the industrial lift truck.

With additional reference to FIG. 2, the industrial lift truck 10 has a hydraulic system 30 which controls movement of the boom 20, arm 22, and load carrier 24. Hydraulic fluid for that system is held in a reservoir, or tank, 32 from which the fluid is drawn by a conventional pump 34 and fed through a check valve 36 into a supply line 38 that runs through the industrial lift truck. A tank return line 40 also runs through the truck and provides a path for the hydraulic fluid to flow back to the tank 32. A pair of pressure sensors 42 and 44 provide electrical signals that indicate the pressure in the supply line 38 and the tank return line 40, respectively.

The supply line 38 furnishes hydraulic fluid to a first electrohydraulic proportional valve (EHPV) assembly 50 comprising four proportional solenoid valves 51, 52, 53, and 54 which control the flow of fluid to and from a boom hydraulic cylinder 56 that raises and lowers the boom 20. Each of these valves and other proportional solenoid valves in the system 30 are bidirectional in that they can control the flow of hydraulic fluid flowing in either direction through the valve. Alternatively double acting solenoid valves can be used. A first pair of the solenoid valves 51 and 52 governs the fluid flow to and from a upper chamber 55 on one side of the piston in the boom hydraulic cylinder 56, and a second pair of the solenoid valves 53 and 54 controls the fluid flow to and from a lower cylinder chamber 57 on the other side of the piston. By sending pressurized fluid into one cylinder chamber and draining the fluid from the other chamber, the boom 20 can be raised and lowered in a controlled manner. A first pair of pressure sensors 58 and 59 provide electrical signals indicating the pressure in the two chambers of the boom hydraulic cylinder 56.

The supply line 38 and the tank return line 40 extend onto the boom 20 and are connected to a second EHPV assembly 60 that controls the flow of hydraulic fluid into and out of an arm hydraulic cylinder 66. The second EHPV assembly 60 comprises another set of four proportional solenoid valves 61, 62, 63, and 64 connected to the arm hydraulic cylinder chambers. This enables the arm 22 to be extended from and retracted into the boom 20. A second pair of pressure sensors 68 and 69 provide electrical signals indicating the pressure in the two chambers of the arm hydraulic cylinder 66. The hydraulic cylinders 56, 66, and 76 form actuators that produce movement of the components of the boom-arm-load carrier assembly.

The supply and tank return lines 38 and 40 extend along the boom and arm to a third EHPV assembly 70 with four additional proportional solenoid valves 71, 72, 73, and 74 that control fluid flow to and from a load carrier hydraulic cylinder 76 that tilts the load carrier 24 up and down with respect to the longitudinal axis of the arm 22. A third pair of pressure sensors 78 and 79 provide electrical signals indicating the pressure in the two chambers 75 and 77 of the load carrier hydraulic cylinder 76.

The EHPV assemblies 50, 60, and 70 are operated by electrical signals from an electronic controller 80. The controller 80 has a conventional hardware design that is based around a microcomputer and a memory in which the programs and data for execution by the microcomputer are stored. The microcomputer is connected input and output circuits that interface the controller to the operator inputs, sensors and valves of the hydraulic circuit 30. Specifically, the controller 80 receives an input signal from a joystick 82 (FIG. 1) or other operator input device that indicates how the operator of the industrial truck 10 desires to move the boom-arm-load carrier assembly. Signals from the sensors 21, 23, and 25 that respectively detect the positions of the boom 20, arm 22, and load carrier 25 are applied to the controller inputs along with the signals from pressure sensors 58, 59, 68, 69, 78, and 79.

Figure 3:
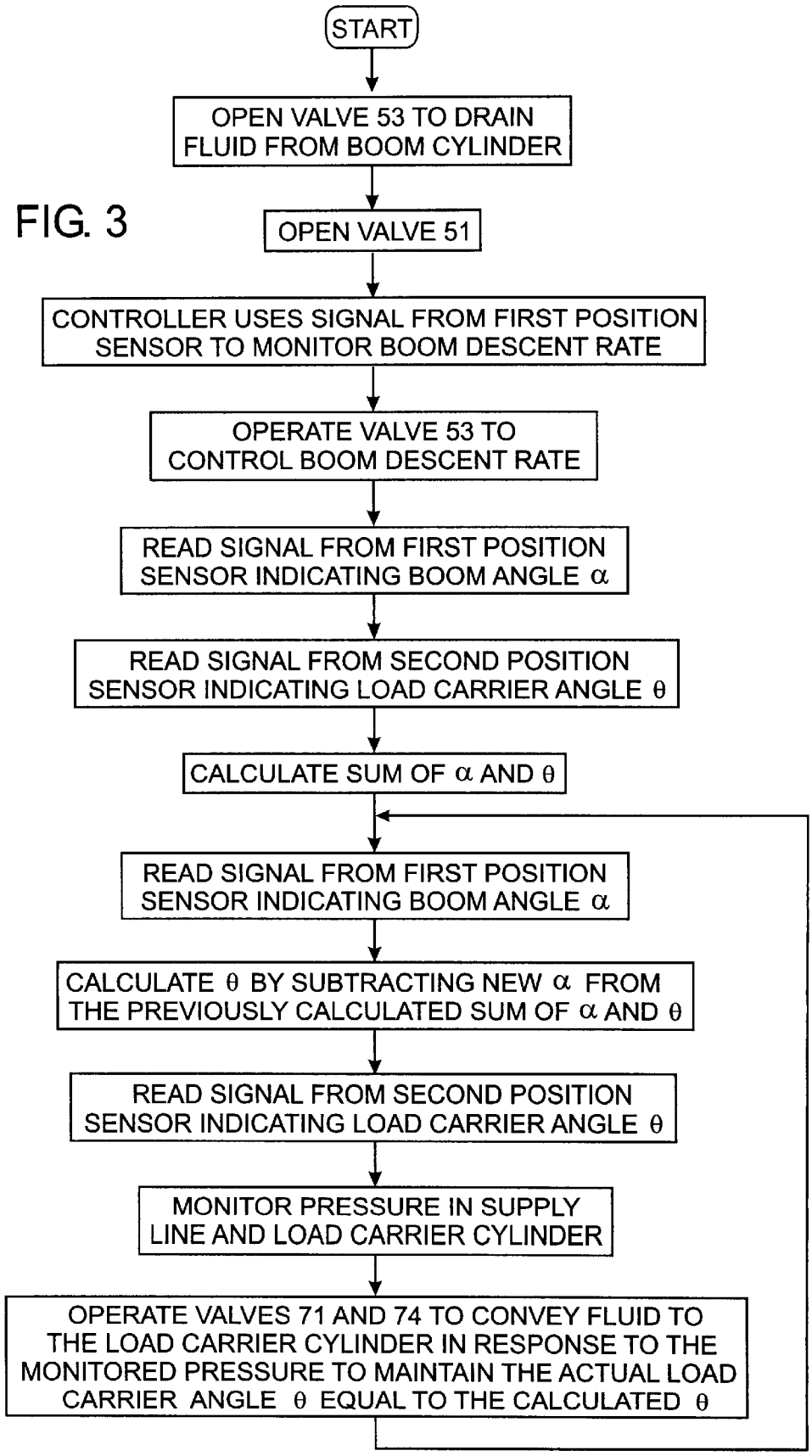
FIG. 3 is a flowchart of the operation of the hydraulic circuit during an emergency.

The controller 80 incorporates a software routine depicted in FIG. 3 that controls lowering of the boom-arm-load carrier assembly in an emergency situation in which the pump no longer supplies pressurized hydraulic fluid to the supply line 38, as would occur when the engine or motor driving the pump fails, for example. In that event, the operator activates a switch 84 in the cab 14 which signals the controller 80 to execute the emergency boom lowering software routine. This procedure utilizes the force of gravity to lower the boom 20 and the attached arm 22 and load carrier 24, while metering the fluid from the boom cylinder 56 at a controlled rate to govern the speed at which the boom descends. A novel feature is that the fluid being drained from the boom cylinder 56 is used to power the load carrier cylinder 76, so that the load carrier 24 is maintained at a substantially constant angular relationship with respect to the ground 19 thereby preventing the load 26 from sliding off. It will be understood that this angular relationship does not have to be held precisely constant as long as the variation is not significant enough to allow the load 26 to slide off the load carrier 24.

During this emergency routine, the controller 80 opens the third proportional solenoid valve 53 in the first EHPV assembly 50 to allow fluid from the lower chamber 57 of the boom cylinder 56 to drain into the supply line 38, as the force of gravity moves the boom downward. The check valve 36 prevents that fluid from flowing back through the now idle pump 34. The first proportional solenoid valve 51 in the first EHPV assembly 50 also is opened by the controller so that some of the fluid flows into the expanding upper chamber 55 of the boom cylinder 56 as the boom descends. The controller 80 uses the signal from the first position sensor 21 to monitor the rate of boom descent and responds by controlling the degree to which the first proportional solenoid valve 51 is opened. That valve control regulates the flow of fluid from the lower boom cylinder chamber 57 and thus control the rate of descent.

Because the upper chamber 55 of the boom cylinder 56 is smaller in volume than its lower chamber 57 some of the fluid flows into the supply line 38 under pressure. That pressurized fluid is used to power the load carrier cylinder 76 and prevent the load 26 from falling off the carrier 24. Referring to FIG. 1, as the angle α between the descending boom 14 and the truck carriage 12 decreases, the angle θ between the load carrier 24 and the longitudinal axis of the arm 22 must increase by an equal amount to maintain a substantially constant angular relationship between the load carrier and the ground 19. In other words, the sum of those two angles α and θ should be held substantially constant. It will be understood that this sum does not have to be held precisely constant as long as the variation is not significant enough to allow the load 26 to slide off the load carrier 24. Therefore, when the emergency lowering commences, the controller 80 reads the signals from the first position sensor 21 which measures the boom angle α and from the second position sensor 23 which measures the load carrier angle θ. The controller then calculates the sum of those angles. Alternatively, the first and third position sensors 21 and 25 may measure the linear distance that the piston rod extends from the housing of the respective boom and load carrier hydraulic cylinders 56 and 76. In this version, the controller 80 trigonometrically calculates the angles α and θ from the linear measurements.

The controller 80 continues to read the signal from the first position sensor 21 to determine the change in the boom angle α. Subtracting that measured boom angle α from the previously calculated sum of the angles produces a new value for the load carrier angle θ in order to maintain the load carrier 24 at the desired orientation. As the boom lowers, angle α decreases producing a larger calculated value for the load carrier angle θ.

Physically pivoting the load carrier 24 into this new angular position θ requires retraction of the piston rod into the load carrier cylinder 76. To accomplish this, the controller 80 monitors the pressure in the supply line 38 by reading the signal from the pressure sensor 42 in that line and monitors the pressure in the upper chamber 75 of the load carrier cylinder 76 by reading the signal from the associated pressure sensor 42. The pressure in that upper chamber 75 results from the force of gravity acting on the load and must be overcome in order to tilt the load into the desired angle. When the pressure in the supply line 38 is greater than the pressure in upper chamber 75, the controller 80 opens the first proportional solenoid valve 71 in the third EHPV assembly 70 so that pressurized fluid flows from the supply line into the upper chamber 75 of the load carrier cylinder 76. At the same time, the fourth proportional solenoid valve 74 in the third EHPV assembly 70 is opened to drain fluid from the lower carrier cylinder chamber 77 into the tank return line 40 and thus the tank 32. The controller 80 controls the degree to which the first proportional solenoid valve 71 in the third EHPV assembly 70 is opened in order to regulate the rate at which the load carrier 24 is drawn toward the arm 22. The controller monitors the signal from the third position sensor 23 to achieve the desired angle θ between the load carrier 24 and the arm 22 to maintain a constant angular relationship of the load carrier with the ground 19.

Any excess fluid that is drained from the boom cylinder 56 that is not consumed by the movement of the cylinders 56 and 76 is sent to the tank 32 by opening the fourth proportional solenoid valve 54 in the first EHPV assembly 50 a small amount so that adequate pressure is maintained in the supply line 38.

In another embodiment of the present invention, an inclinometer can be employed as the third position sensor 25. This type of sensor detects the angle that the load carrier 24, an specifically the forks of that component, tilt with respect to the horizontal axis. In this version, the first and second sensors 21 and 23 are not required to lower the boom assembly in an emergency. Instead, the controller 25 responds to the signal from the inclinometer by operating the third EHPV assembly 70 so that the load carrier hydraulic cylinder 76 pivots the load carrier as the boom 20 descents, thereby maintaining a substantially constant inclination of the load carrier with respect to the horizontal axis. This action keeps the load 26 from sliding off the load carrier 24.

The foregoing description was primarily directed to a preferred embodiment of the invention. Although some attention was given to various alternatives within the scope of the invention, it is anticipated that one skilled in the art will likely realize additional alternatives that are now apparent from disclosure of embodiments of the invention. Accordingly, the scope of the invention should be determined from the following claims and not limited by the above disclosure.

What is claimed is:

1. In a machine having a boom, that is moved by a first hydraulic actuator, and a load carrier, that is coupled to the boom and moved with respect thereto by a second hydraulic actuator; a method for moving the boom when pressurized fluid from a source is not available, said method comprising:

sensing a first position of the boom;

draining hydraulic fluid under pressure from the first hydraulic actuator without applying pressurized fluid from the source to the first hydraulic actuator;

conveying the hydraulic fluid from the first hydraulic actuator to the second hydraulic actuator without employing pressurized fluid from the source; and controlling flow of the hydraulic fluid into the second hydraulic actuator in response to the first position of the boom to produce movement of the load carrier with respect to the boom, wherein as the boom moves, an angular relationship of the load carrier with respect to a surface on which the machine is supported is maintained substantially constant.

2. The method as recited in claim 1 wherein controlling flow of the hydraulic fluid comprises:

sensing a first pressure of the fluid draining from the first hydraulic actuator;

sensing a second pressure of fluid in the second hydraulic actuator; and enabling the hydraulic fluid to enter the second hydraulic actuator in response to the first pressure being greater than the second pressure.

3. The method as recited in claim 1 wherein controlling flow of the hydraulic fluid comprises:

measuring a first angle representing the first position of the boom;

measuring a second angle between the load carrier and the boom;

calculating a sum of the first angle and the second angle; and as the first angle changes when the boom descends, controlling the flow of the hydraulic fluid to move the load carrier and vary the second angle to maintain the sum of the first angle and the second angle substantially constant.

4. The method as recited in claim 1 wherein controlling flow of the hydraulic fluid comprises:

measuring a first angle representing the first position of the boom;

measuring a second angle representing a position of the load carrier with respect to the boom; and regulating the flow of the hydraulic fluid to move the load carrier so that the second angle changes by an amount that is substantially equivalent to an amount the first angle changes.

5. The method as recited in claim 1 further comprising:

deriving, from the first position, a desired position for the load carrier; and the flow of the hydraulic fluid is controlled to place the load carrier into the desired position.

6. The method as recited in claim 1 further comprising:

sensing a second position of the load carrier;

deriving from the first position a desired position for the load carrier; and wherein controlling flow of the hydraulic fluid comprises terminating that flow when the second position corresponds to the desired position.

7. The method as recited in claim 1 wherein controlling flow of the hydraulic fluid comprises:

measuring a positional change of the boom with respect to a reference point on the machine; and controlling the flow of the hydraulic fluid in response to the positional change of the boom to produce a corresponding change in the position of the load carrier with respect to the boom.

8. The method as recited in claim 1 wherein controlling flow of the hydraulic fluid comprises:

sensing inclination of the load carrier with respect to a given axis; and as the boom descends, controlling the flow of the hydraulic fluid to move the load carrier to maintain the inclination of the load carrier with respect to the given axis substantially constant.

9. In a machine having a pump, a boom, and a load carrier coupled to the boom, wherein the boom is moved by a first hydraulic actuator that has first and second chambers and the load carrier is moved with respect to the boom by a second hydraulic actuator that has third and fourth chambers, a method for lowering the boom during an abnormal operating condition comprising:

coupling the first hydraulic actuator to a supply line and a tank return line by a first valve assembly, wherein the supply line receives pressurized fluid from the pump under normal operating conditions;

coupling the second hydraulic actuator to the supply line and the tank return line by a second valve assembly;

when pressurized fluid is unavailable from the pump, activating the first valve assembly to drain hydraulic fluid under pressure from the first chamber of the first hydraulic actuator into the supply line, which results in the boom lowering; and when pressurized fluid is unavailable from the pump, selectively activating the second valve assembly to cause hydraulic fluid to flow from the supply line into the third chamber of the second hydraulic actuator, wherein as the boom lowers, an angular relationship of the load carrier with respect to a surface on which the machine is supported is maintained substantially constant.

10. The method as recited in claim 9 further comprising:

sensing a first pressure of the fluid draining from the first hydraulic actuator;

sensing a second pressure of fluid in the third chamber of the second hydraulic actuator; and wherein the second valve assembly is selectively activated in response to the first pressure being greater than the second pressure.

11. The method as recited in claim 9 wherein selectively activating the second valve assembly comprises:

measuring a first angle representing a position of the boom;

measuring a second angle representing a position of the load carrier with respect to the boom; and activating the second valve assembly to apply hydraulic fluid to the second hydraulic actuator so that the second angle changes by an amount which is substantially equivalent to an amount that the first angle changes.

12. The method as recited in claim 11:

further comprising calculating a sum of the first angle and the second angle; and controlling the second valve assembly; and wherein activating the second valve assembly controls flow of the hydraulic fluid to vary the second angle so that the sum of the first angle and the second angle is maintained substantially constant.

13. The method as recited in claim 9 further comprising:

sensing a first position of the boom;

deriving, from the first position, a desired position for the load carrier; and the flow of the hydraulic fluid is controlled to place the load carrier into the desired position.

14. The method as recited in claim 9 further comprising activating the first valve assembly to cause hydraulic fluid to flow into the second chamber of the first hydraulic actuator from the supply line.

15. The method as recited in claim 9 further comprising activating the second valve assembly to cause hydraulic fluid to drain from the fourth chamber of the second hydraulic actuator into the tank return line.

16. The method as recited in claim 9 further comprising conveying an amount of hydraulic fluid, that is drained from the first hydraulic actuator, into the tank return line.

17. In a machine having a boom, that is moved by a first hydraulic actuator, and a load carrier, that is coupled to the boom and moved with respect thereto by a second hydraulic actuator; a method for moving the boom comprising:

when pressurized fluid from a source is not available draining hydraulic fluid under pressure from the first hydraulic actuator;

when pressurized fluid from the source is not available, conveying the hydraulic fluid from the first hydraulic actuator to the second hydraulic actuator;

sensing inclination of the load carrier with respect to a given axis; and controlling flow of the hydraulic fluid into the second hydraulic actuator to produce movement of the load carrier which maintains the inclination of the load carrier with respect to the given axis substantially constant.

18. The method as recited in claim 17 wherein controlling flow of the hydraulic fluid comprises:

sensing a first pressure of the fluid draining from the first hydraulic actuator;

sensing a second pressure of fluid in the second hydraulic actuator; and enabling the hydraulic fluid to enter the second hydraulic actuator further in response to the first pressure being greater than the second pressure.

* * * * *